United States Patent [19]

Smith, Jr.

[11] 4,130,178

[45] Dec. 19, 1978

[54] ELEVATING DEVICE

[76] Inventor: Raymond E. Smith, Jr., 385 E. Greenwood, Lake Forest, Ill. 60045

[21] Appl. No.: 782,183

[22] Filed: Mar. 28, 1977

[51] Int. Cl.[2] ..... E04G 1/22

[52] U.S. Cl. ..... 182/141; 182/63; 187/18; 52/109

[58] Field of Search ..... 182/63, 148, 141; 52/109; 187/18; 254/122; 248/277

[56] References Cited

U.S. PATENT DOCUMENTS

| | | | |
|---|---|---|---|
| 3,442,351 | 5/1969 | Parrish | 182/141 |
| 3,596,735 | 8/1971 | Denier | 182/148 |
| 3,820,631 | 6/1974 | King | 182/141 |

FOREIGN PATENT DOCUMENTS

| | | | |
|---|---|---|---|
| 213847 | 9/1909 | Fed. Rep. of Germany | 248/277 |

*Primary Examiner*—Reinaldo P. Machado
*Attorney, Agent, or Firm*—Cook, Wetzel & Egan, Ltd.

[57] ABSTRACT

An elevating device is described having one or more pairs of crossed scissors members, each member having at least two telescoping sections. The scissors members are mounted for pivotal movement with respect to each other, and means are included for interconnecting opposed scissors members for effecting extension of the telescoping sections in response to the pivoting of the scissors members.

16 Claims, 5 Drawing Figures

ELEVATING DEVICE

BACKGROUND OF THE INVENTION

This invention relates generally to elevating devices for lifting work platforms and the like. It is particularly directed to such devices which are constructed of crossed scissors members which are pivotably mounted to extend and fold between raised and lowered positions, respectively.

Prior elevating devices constructed of scissors members have typically included a stacked array of similar scissors members, each such stack comprising a pair of scissors members which cross each other in the form of an "X" and are pivotably coupled to be extended together. Each such stack is pivotably coupled to adjacent upper and lower stacks so that as pairs of crossed scissors members are caused to unfold, the entire array extends vertically to elevate a platform or the like mounted on the top stack of scissors members.

At any given extension of the scissors members, each such member has a fixed vertical extension and a fixed horizontal extension. As the scissors members unfold to elevate the platform, their vertical dimension increases and their horizontal dimension decreases. Thus, when the scissors members are completely unfolded, they exhibit their maximum vertical extension and their minimum horizontal extension. Conversely, when the scissors members are folded for lowering the platform, they exhibit their minimum vertical extension and their maximum horizontal extension. Typically, at the maximum elevation of such a device, its horizontal dimension is reduced by one-half.

To accommodate the variable horizontal dimension or width of the scissors members, the foot of one of the bottom members is conventionally made movable in a track. In like manner, the top of one of the uppermost crossed members which supports the work platform is also movable in a track on the work platform to allow the uppermost crossed members to move apart or together laterally as the platform is lowered and raised, respectively.

A problem with such elevating devices is that, as the platform is raised, the upper ends of the topmost scissors members become more closely spaced, thereby providing a narrower base of support for the platform. Because the platform itself does not contract as it is elevated, one end of the platform may extend much farther horizontally beyond the topmost ends of the upper crossed members than it does when in the lowered position. Thus, that part of the platform which is so extended is cantilevered about the topmost end of one of the upper crossed members. As a result, the platform must be strengthened to ensure that the extended portion of the platform remains rigid. This is particularly important where the platform supports a heavy weight such as a boom or crane which may be located on the extended portion of the platform.

An associated problem of such prior elevating devices is the variable distribution of their load on the base. Because such bases generally come equipped with wheels to render the elevating device mobile, it is desirable to concentrate the load of the device near the front and rear axles. Because the load of the elevating device is transmitted to the base via the bottom scissors members, the point at which the load bears on the base varies as the elevating device is extended and the feet of the bottom scissors members move laterally toward each other. Accordingly, if the elevating device is positioned to apply the load to the base at points directly above the axles when the scissors members are folded, unfolding the scissors members necessarily moves the location of the load on the base. The base must accordingly be strengthened to bear the load wherever it is applied.

An additional problem associated with prior extendible elevating devices is that it has been necessary to include as many as four or more stacked arrays of scissors members in order to elevate the work platform to the desired height. Because every array of scissors members is pivotally connected to adjacent upper and lower arrays, a large number of pivot points is required. Moreover, each additional pivot point that must be included lessens the stiffness of the scaffold and increases its over-all resilience, thereby increasing its propensity to sway. Further, increasing the number of stacked arrays to reach a given height substantially increases the weight of the scaffold.

Accordingly, it is an object of this invention to provide an extendible elevating device which overcomes the above-noted deficiencies of prior devices.

It is a more specific object of this invention to provide an extendible elevating device which requires fewer stacked arrays of crossed members to elevate a work platform to a given height.

It is another object of this invention to provide an extendible elevating device whose width does not substantially vary as the scaffold is extended and which is lighter in weight and more rigid than prior elevating devices.

These and other objects of the invention are more particularly set forth in the following detailed description and in the accompanying drawings of which:

DESCRIPTION OF THE PREFERRED EMBODIMENT

Broadly stated, the invention described herein is an elevating device having one or more pairs of crossed scissors members, each member having at least two telescoping sections. The scissors members are mounted for pivotal movement with respect to each other, and means are included for interconnecting opposed scissors members for effecting extension of the telescoping sections in response to the pivoting telescoping movement of each scissors sleeve of the scissors members. As a result of the extension of the telescoping sections of the scissors members, the horizontal extension of each scissors member is maintained relatively constant while the vertical extension thereof is increased. Accordingly, the load of the elevating device bears on a supporting base at a nearly constant predetermined position. Further, a work platform supported by the topmost scissors members is supported at nearly the same points regardless of the extent of its elevation.

Figure 1:
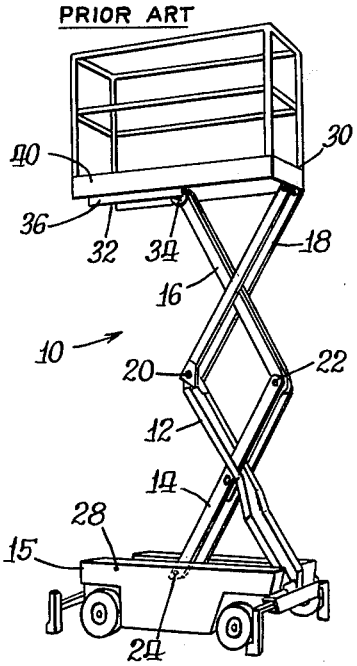
Fig. 1. PRIOR ART
FIG. 1 is a perspective view of a conventional elevating device.

The above-described problems with prior elevating devices may be more readily understood by reference to FIG. 1 which illustrates a conventional elevating device 10 in its extended position. As shown, the elevating device 10 includes a first pair of crossed scissors members 12 and 14 pivotally mounted on a base 15. A second pair of scissors members 16 and 18 are mounted atop the scissors 12 and 14 and are pivotally connected to the scissors 12, 14 at points 20 and 22 to enable the device to extend vertically when a suitable power source, such as pistons (not shown) cause the scissors to assume the unfolded position shown.

As explained above, such a conventional elevating device contracts horizontally as it extends vertically. For example, in the position shown the foot of the scissors member 14 is at the position indicated at 24 on a supporting base 26. However, as the elevating device 10 is folded or closed, the foot of the scissors member 14 ultimately moves to the position indicated at 28. To accommodate this lateral movement of the scissors member 14, a roller (not shown) is mounted on the foot of the scissors member 14 and advances in a track (not shown) situated in the base 15.

Because of the lateral movement of the scissors member 14, the bearing point of the load which is thereby applied to the base 15 varies from position 24 to position 28. Accordingly, the base 15 must be strengthened to support the load wherever it may bear. To accommodate the lateral movement of the scissors member 16, a work platform 30 includes a track 32 for guiding a roller 34 between the position shown and a position indicated at 36. The problem associated with the lateral movement of the scissors member 16 resides in the fact that a portion 40 of the platform 30 which extends beyond the scissors member 16 is, in effect, cantilevered at the location of the roller 34. This can result in a degree of instability in the platform 30 and necessarily requires that the platform and its supporting structure be strengthened to accommodate the effect of the extended portion 40 of the platform. This is particularly significant when the extended portion 40 bears a heavy load such as a boom or crane.

A further undesirable aspect of the device 10 is that, to reach a given height, four or more vertical stacks of scissors members may be required, thus undesirably increasing the weight of the device. In addition, more pivot points such as pivots 20 and 22 are required, thereby increasing the resiliency of the device and its tendency to sway.

Figure 2:
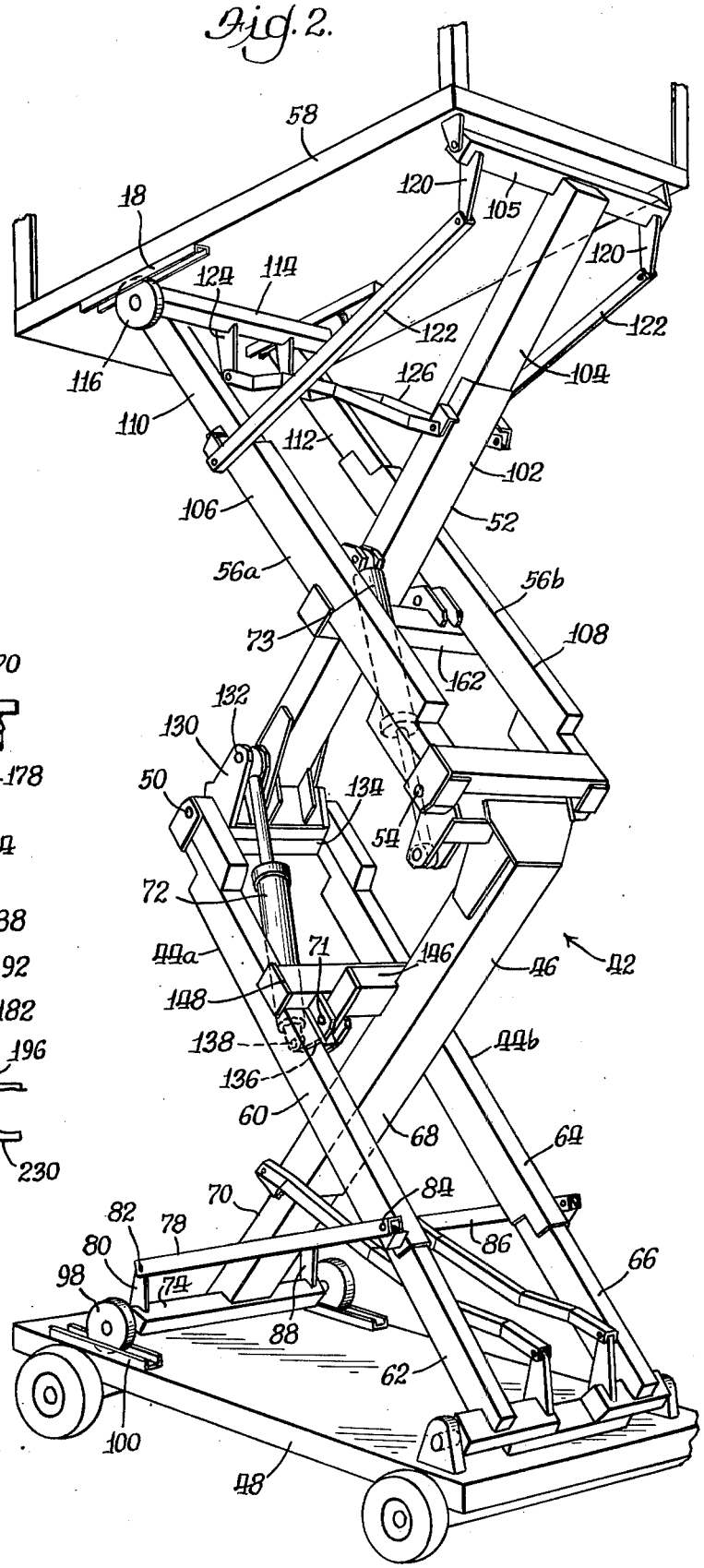
FIG. 2 is a perspective view of an elevating device constructed in accordance with the invention.

Referring now to FIG. 2, there is shown an exemplary elevating device 42 constructed in accordance with the invention. The elevating device 42 includes a lower pair of crossed telescoping scissors members, one scissors member comprising two substantially parallel, outer legs 44*a* and 44*b* spaced apart from each other, and the opposed scissors member comprising the inner leg 46, all mounted on a supporting base 48. The scissors member comprising the legs 44*a* and 44*b* is pivotally connected at 50 to an upper scissors member comprising an inner leg 52. The leg 46 is pivotally connected at 54 to another scissors member comprising the upper outer legs 55*a* and 56*b*. A pair of pistons, 72 and 73, are coupled between the scissors members as shown to extend the elevating device 42. In the condition illustrated, the various scissors members are in an extended position for elevating a work platform 58 mounted atop the upper pair of scissors members.

Directing attention first to the lower pair of scissors members (legs 44*a*, 44*b* and 46), each leg thereof is adapted to telescope by virtue of having an outer sleeve and an inner shaft disposed in telescoping relationship. Specifically, the leg 44*a* includes an outer sleeve 60 and an inner shaft 62, the sleeve 60 being movable along its longitudinal axis with respect to the shaft 62. The arm 44*b* likewise includes an outer sleeve 64 disposed in telescoping relationship with a shaft 66. The arm 46 is similarly constructed of an outer sleeve 68 disposed in telescoping relationship with an inner shaft 70. Each of the arms 44*a*, 44*b* and 46 are pivotable about a point 71.

By virtue of the ability of each leg of the scissors members to telescope, each leg may be extended in a diagonal direction which includes both a vertical and a horizontal component for elevating the work platform 58 while simultaneously retaining the horizontal spacing between the ends of opposed legs at a substantially contant distance. Such telescoping is, in general, effected by pivoting opposed legs of the scissors members and interconnecting the opposed legs, in a manner to be described below, to translate the pivoting motion of one leg to a telescoping movement of the opposed leg. The structure which permits such motion will be described first with respect to arms 44*a*, 44*b* and 46.

Interconnecting the sleeve 60 and the shaft 70 is a linkage comprising a link bar 78 and a bracket 80, pivotably connected at 82. The link bar 78 is also pivotable at its opposed end by virtue of a pivoting connection between the link bar 78 and sleeve 60 at point 84.

A second linkage comprising a link bar 86 and a bracket 88 are coupled between the sleeve 64 and the shaft 70, similarly to link bar 78 and bracket 80. The brackets 80 and 88 are coupled to the shaft 70 by virtue of the brackets 80, 88 and the shaft 70 being rigidly connected to the support bar 74. Accordingly, any forces exerted axially on the link bars 78 and 86 will be transmitted to the shaft 70 via the corresponding brackets 80 and 88 and the support bar 74.

At the opposite end of the base 48 there is a second support bar 90 which is pivotable about its longitudinal axis. The shafts 62 and 66 are rigidly connected to the support bar 90 as are a pair of brackets 96, the latter being coupled to the sleeve 68 via a pair of link bars 94. By virtue of the interconnection of the sleeve 68 and the shafts 62 and 66, any force exerted by the sleeve 68 axially on the link bars 94 will be transmitted to the shafts 62 and 66 via the brackets 96 and the support bar 90.

The way in which the pivoting of one arm results in the telescoping of the opposed arm will now be described. As the pistons 72 and 73 extend their respective piston rods, the sleeve 52 will be forced upwardly and will pivot about the point 50. The sleeves 60 and 64 are also pivotable about the point 50 so that the operation of the piston 72 unfolds the sleeve 52 with respect to the sleeves 60 and 64. Similarly, sleeves 106 108 pivot about the point 54 and unfold with respect to the sleeve 68.

As the pistons 72 and 73 extend their respective piston rods, the arms 44*a*, 44*b* and 46 pivot about the point 71, as a result of which forces are exerted on the respective sleeves 60, 64 and 68, which forces are applied to the link bars 78, 86 and 94 for extending the shafts 70, 62 and 66. For example, as the arms 44*a* and 44*b* rotate about the point 71, an axial force is applied to the link bars 78 and 86 and from there via the brackets 80 and 88 and support bar 74 to the shaft 70 for extending the shaft 70 and telescoping it with respect to its sleeve 68. In like manner, as the arm 46 pivots about the point 71, an axial force is applied to the link bars 94, which force is coupled via the brackets 96 and the support bar 90 to the shafts 62 and 66 for telescoping them with respect to their mating sleeves 60 and 64. Thus, as the pistons 72 and 73 extend, the arms 44*a*, 44*b* and 46 pivot about the point 71 for applying a force via their linkages to the shafts of opposing arms so as to telescope those arms with respect to their mating sleeves and to thereby extend the elevating device 42.

By virtue of the telescoping of the arms 44*a*, 44*b* and 46, their uppermost ends are elevated and the horizontal displacement which would otherwise result from their pivoting is compensated for by the outward horizontal components of their telescoping movement, thereby causing the pivot points 50 and 54 to raise substantially vertically without any substantial horizontal motion. Likewise, the bottom ends of the shafts 62, 66 and 70 also undergo very little horizontal motion. However, to accommodate a small amount of relative horizontal movement of the supporting bars 74 and 90, the support bar 74 has its outer ends mounted on a pair of rollers 98 which are situated in a corresponding pair of tracks 100 in the base 48. In practice, it has been found that the support bar 74 moves no more than approximately four inches as the elevating device 42 is extended from a lowered position to its most elevated position. As a result, the load which is imposed upon the base 48 tends to bear on the base at substantially the same location regardless of the degree of extension of the elevating device 42.

Having described how the telescoping of the legs 44*a*, 44*b* and 46 is accomplished, it is to be understood that the upper telescoping legs 52, 56*a* and 56*b* undergo a similar telescoping action in response to their pivoting, and by virtue of the fact that they have similar interconnecting linkages. Specifically, the leg 52 includes a sleeve 102 disposed in telescoping relationship with a mating inner shaft 104, the shaft 104 being rigidly attached to an elongated support bar 105 which is pivotable about its longitudinal axis. Similarly, the legs 56*a* and 56*b* include respective outer sleeves 106 and 108 disposed in telescoping relationship with a corresponding pair of inner shafts 110 and 112. The shafts 110 and 112 are rigidly mounted to an elongated support bar 114 which is pivotable about its longitudinal axis. As shown, the support bar 105 is mounted on the work platform 58 so as to preclude any horizontal motion thereof. Support bar 114, however, is mounted on rollers 116 which are disposed in a pair of tracks 118 mounted on the support platform 58.

In order to telescope the shafts 104,110 and 112, the support bar 105 has mounted thereon a pair of upstanding brackets 120 pivotably connected to a corresponding pair of link bars 122, the latter of which are pivotably connected to the sleeves 106 and 108. Similarly, the support bar 114 has mounted thereon a pair of brackets 124 pivotably connected to a pair of link bars 126, the latter of which are pivotably connected to the sleeve 102. As the pistons 72 and 73 are actuated, the arms 52, 56*a* and 56*b* pivot about a point 156 (FIG. 3) to impose a force on the link bars 122 and 126 for extending the shafts to which they are connected. For example, as the arm 56*a* pivots about the point 156, it imposes an axial force on the links 122, which force is transmitted via the brackets 120 to the support bar 105 for extending the shaft 104. In like manner, the pivoting of the arm 52 directs an axial force along the length of the link bars 126 which is coupled to the support bar 114 via the brackets 124, thereby extending the shafts 110 and 112.

Although the extension of the various telescoping arms has been described separately, it is to be understood that the actuation of the pistons 72 and 73 occurs simultaneously and that the various telescoping arms are also extended simultaneously to elevate the platform 58.

Having described how the telescoping of the various legs is accomplished in response to the pivoting motion of opposed legs, the structure for effecting such pivoting will now be described with reference to FIGS. 2 and 3.

As pointed out above, the pistons 72 and 73 initiate the pivoting of the legs of the various scissors members. Referring first to piston 72, one end thereof is connected via a piston rod 128 to a bracket 130. A pivotal connection is made at 132 between the bracket 130 and the piston rod 128. The bracket 130 is mounted on a cross-member 134, the latter being mounted between the arms 44*a* and 44*b* and coupled to the upper center leg 52.

The opposite end of the piston 72 is pivotally coupled to a U-shaped bracket 136 at 138. The bracket 136 is pivotal at 71 and is connected thereat to a bracket 142. The bracket 142 is rigidly mounted on a cross-member 146 (best seen in FIG. 2), the latter being rigidly coupled to the lower center leg 46. The bracket 136 is also connected to a cross-member 148 which is fastened to the lower outer legs 44*a* and 44*b*.

When the piston 72 is operated to initiate the elevation of the device 42 from a folded or lowered position to an extended position, the piston rod 128 begins to extend, thereby pushing against the bracket 136 at the point 138 and causing the arms 44*a*, 44*b* and 46 to pivot about the point 71, due to the fact that the lower arms 44*a*, 44*b* and 46 are pivotably connected to the upper arms 52, 56*a*, and 56*b* at the points 50 and 54 and the upper arms 52, 56*a*, and 56*b* are pivotably connected at point 156. Accordingly, the arms 44*a*, 44*b* and 46 pivot about a common horizontal axis extending through the point 71, which common axis intermediate the upper and lower ends of the arms 44*a*, 44*b* and 46.

In addition to the force exerted on the bracket 136, the extension of the piston rod 128 results in a force being applied to the bracket 130 and the cross-member 134, as a result of which the arm 52 pivots about the point 50 and unfolds with respect to the arm 44*a*.

As the lower legs are pivoting, the linkages which are cross-connected between the lower legs 44*a*, 44*b* and 46 cause the shafts of the respective legs to telescope. Thus, the pivoting of the legs results in the various legs being extended such that the inward horizontal motion of the legs which would otherwise occur as a result of their pivoting is offset by the outward telescoping of the legs. The net result is a substantially vertical displacement of the upper ends of the arms 44*a*, 44*b* and 46.

The pivoting of the upper legs 52, 56*a* and 56*b* is effected in a similar manner. As shown, one end of the piston 73 is pivotably connected at 152 to a U-shaped bracket 154. The bracket 154 is pivotable about the point 156 which it is connected to cross-members 160 and 162. The cross-member 160 is attached to the inner leg 52 with the cross-member 162 being attached to the outer legs 56*a* and 56*b*. The opposite end of the piston 73 is connected via a piston rod 164 to a bracket 166 for pivoting about the point 168.

When the piston rods 128 and 164 begin to extend, the legs 52, 56*a* and 56*b* begin to pivot about the point 156 in a manner similar to that described above with respect to the lower legs 44*a*, 44*b* and 46. In response to such pivoting the linkages 122 and 126 telescope the shafts 104, 110 and 112 for extending the upper legs and elevating the work platform 58. The combination of the pivoting and telescoping of the upper legs thus prevents any substantial horizontal movement at the upper ends of the arms 52, 56*a*, and 56*b*. However, as discussed above, the support bar 114 for the arms 56*a* and 56*b* is mounted on rollers 116 for slight horizontal movement (approximately four inches) in the tracks 118.

Although the elevating device 42 has been described thus far as being elevated by a pair of pistons 72 and 73, the elevation of the device 42 and the telescoping of the various legs can be effected by the use of piston 72 alone, assuming of course that the force exerted by the piston 72 is sufficient to raise the device. The ability of the piston 72 to pivot the various legs and effect their telescoping in co-operation with the various linkages is possible because of the fact that the various arms of the elevating device are constrained to pivot about the four points 50, 54, 71 and 156. Thus, any unfolding of the arms as by the piston 72 necessarily forces the legs to pivot about the four points and to unfold in the manner illustrated. As a result of the pivoting, the various linkages extend the shafts to which they are connected for telescoping them with respect to their mating sleeves.

In addition to the advantages gained by the fact that the elevating device 42 extends vertically without any substantial horizontal motion of the upper and lower ends of the various arms, the elevating device 42 is capable of elevating a work platform to a substantially higher height than that of a prior elevating device such as that shown in FIG. 1 which also has two stacked pairs of scissors members. Because of the fact that fewer stacked pairs of scissors members are required in the elevating device 42 to reach a given height, the elevating device 42 will also be substantially lighter in weight than conventional elevating devices which are capable of reaching the same height. In addition, the elevating device 42 is less resilient and less prone to swaying than conventional devices capable of reaching the same height. This is due to the fact that, because fewer stacked pairs of scissors members are required, fewer pivoting points such as 50 and 54 are required to interconnect the successive stacked arrays of scissors members.

Figure 4:
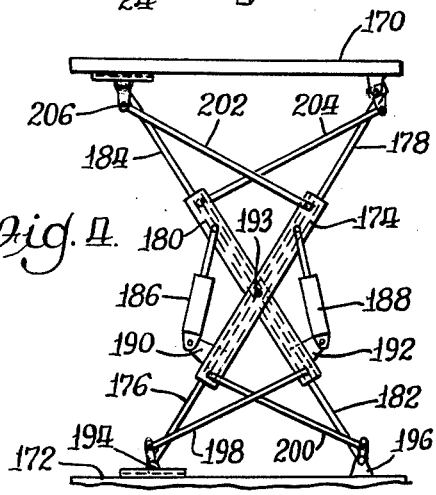
FIGS. 4 and 5 are side elevational views of alternate embodiments of the invention.
Figure 3:
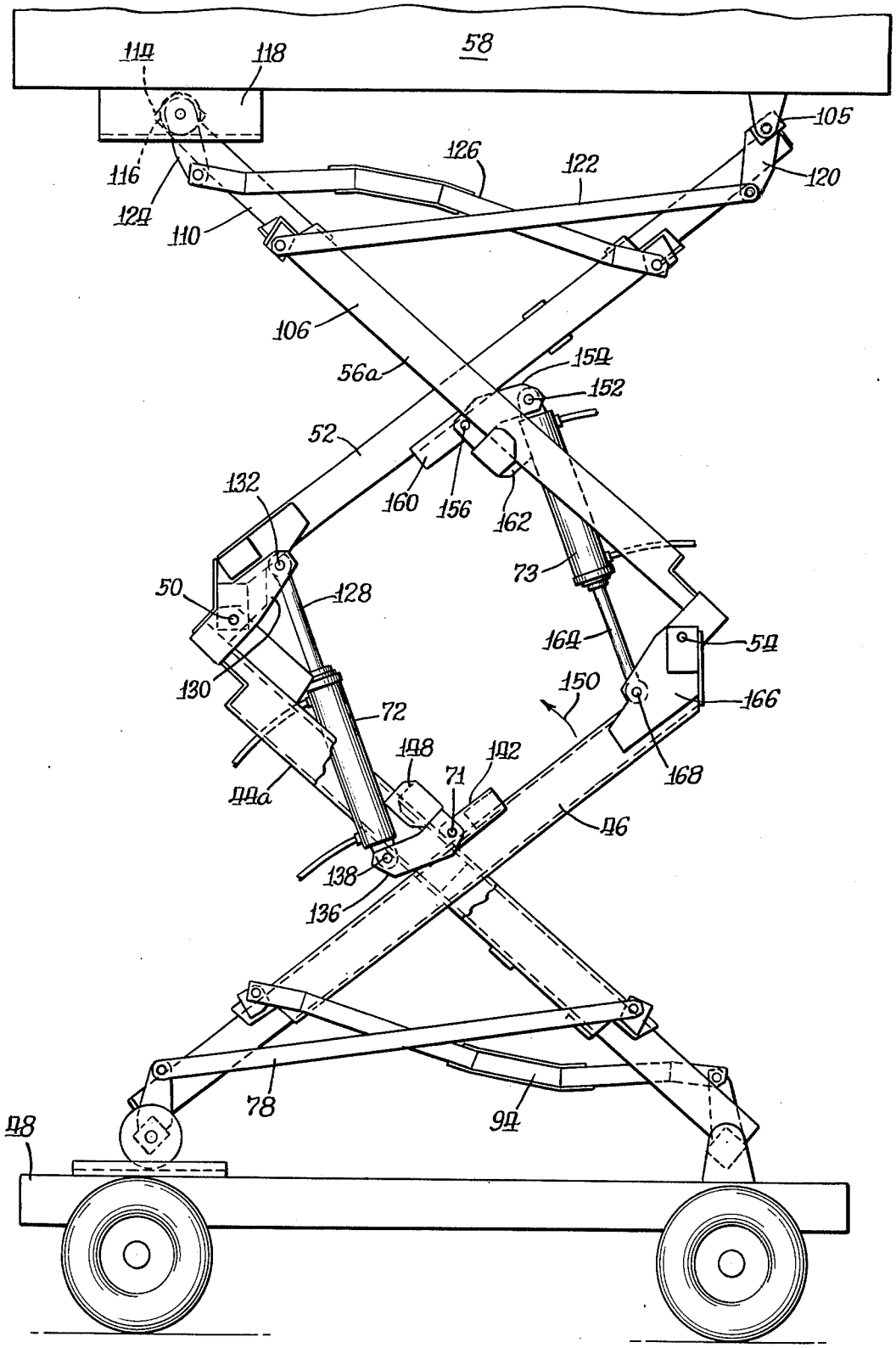
FIG. 3 is a side elevational view of the device shown in FIG. 2.

An elevating device having arms which telescope in response to their pivoting motion have been shown in their preferred form in FIGS. 2 and 3. However, an alternate embodiment which can reach a relatively high height using only one pair of telescoping scissors members is shown in FIG. 4. In the illustrated embodiment, the single array of scissors members is connected between a work platform 170 and a supporting base 172. The first scissors member includes an outer sleeve 174 disposed in telescoping relationship with a lower shaft 176 and an upper shaft 178. The shafts 176 and 178 telescope within the sleeve 174 and may lie along side each other within the sleeve 174.

The second scissors member includes an outer sleeve 180 disposed in telescoping relationship with a lower shaft 182 and an upper shaft 184. The shafts 182 and 184 may also lie along side each other within the sleeve 180.

To pivot the scissors members, a pair of pistons 186 and 188 and brackets 190 and 192 are shown schematically in FIG. 4. It is understood, however, that the pistons 186 and 188 may be coupled to the scissors members of FIG. 4 in a manner similar to that shown with respect to FIGS. 2 and 3 to effect the pivoting of the scissors members.

As the pistons 186 and 188 begin to extend their piston rods, the sleeves 174 and 180 pivot about a common horizontal axis shown schematically as point 193. The interconnection of the sleeves 174 and 180 at the point 193 may be effected in the manner shown in FIG. 2. In response to the pivoting of the sleeves 174 and 180, their lower shafts 176 and 182 are extended by virtue of axial forces exerted on a pair of linkages 198 and 200, as described above with reference to the structure of FIG. 2.

The extension of the shafts 178 and 184 is effected similarly by a pair of cross-connected linkages 202 and 204. The linkage 202 is connected between the sleeve 174 and a pivot point 206. The pivot point 206 is coupled to a supporting bar (not shown) which is pivotably connected to the work platform 170. As the sleeve 174 pivots, a force is applied via the linkage 202 for extending the shaft 184. Similarly, the shaft 178 is extended by the linkage 204 in response to the pivoting of the sleeve 180. This arrangement allows for a maximum lifting elevation with a single pair of scissors members having a single sleeve and a pair of telescoping shafts.

Figure 5:
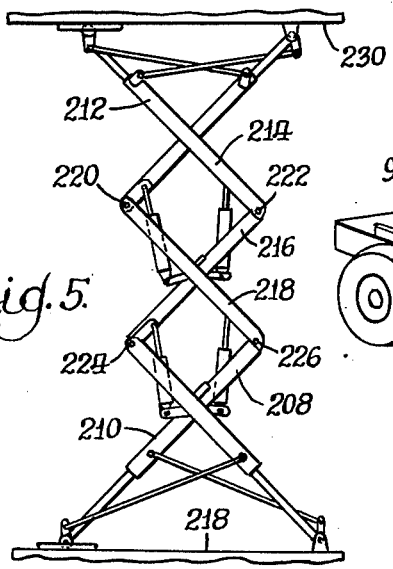

The telescoping scissors members may be advantageously combined with non-telescoping scissors members as shown in FIG. 5 to achieve an elevational height not possible with the two pairs of stacked scissors members. As shown, the elevating device of FIG. 5 includes a lower pair of telescoping scissors members 208 and 210 and an upper pair of telescoping scissors members 212 and 214. Each of these telescoping scissors members may be constructed similarly to those shown in FIG. 2 and include similar interconnecting linkages and pivot points for effecting the telescoping of the various legs of the scissors members.

Disposed between the upper and lower pairs of scissors members is a conventional non-telescoping pair of scissors members 216 and 218. Piston and bracket assemblies for pivoting the scissors members are shown schematically but may be similar to the corresponding structure shown in FIGS. 2 and 3.

In the embodiment of FIG. 5, the center conventional pair of scissors members is joined to the adjacent telescoping scissors members at pivot points 220, 222, 224 and 226. The ends of the scissors members 216 and 218 which are at the pivot points 220, 222, 224 and 226 do move laterally as the scissors members 216 and 218 are pivoted. However, the ends of the telescoping scissors members which bear on the base 228 and the work platform 230 undergo no substantial lateral movement. As a result, the advantages of using telescoping scissors members are not lost, yet a greater possible extension of the elevating device is provided economically by including a conventional non-telescoping scissors member between a pair of telescoping scissors members.

The embodiments described above combine pivoting and telescoping of scissors members in an elevating device which is in many ways superior to conventional elevating devices. The specific construction which has been illustrated and described is, of course, subject to many variations and alterations which will be obvious to one skilled in the art.

Accordingly, the appended claims are intended to embrace all such variations and alterations which fall within the true spirit and scope of the invention.

What is claimed is:

1. An elevating device comprising:

a pair of pivotable legs disposed in a scissors arrangement, each leg including a telescoping section and terminating in an end;

means for pivoting said legs; and means interconnecting the end of each leg with the telescoping section of the opposite leg for effecting extension of said telescoping sections in response to the pivoting of said legs without imparting substantial horizontal movement to the ends of said legs.

2. An elevating device as set forth in claim 1 wherein said legs have respective upper ends and lower ends, wherein said legs are pivoted about a common axis intermediate their upper and lower ends, and wherein said pivoting means includes a piston for pivoting said legs about the common axis.

3. An elevating device comprising:

first and second crossed scissors members pivoted for movement relative to each other and terminating in ends, each crossed scissor member including an outer sleeve and an inner shaft disposed in telescoping relationship;

power means for effective pivoting of said first and second scissors members; and means coupling the end of each scissors member with the sleeve of the opposite scissors member for effecting telescoping between the shafts and sleeves of the respective scissors members in response to the pivoting movement of said first and second scissors members so as to vertically extend the elevating device without imparting substantial horizontal movement to the ends of said scissors members.

4. An elevating device comprising:

first and second crossed scissors members pivoted for movement relative to each other, each crossed scissors member including an outer sleeve and an inner shaft disposed in telescoping relationship;

power means for effecting pivoting of said first and second scissors members; and means responsive to the pivoting movement of said first and second scissors members for effecting telescoping between the shafts and sleeves of the respective scissors members so as to vertically extend the elevating device, said means for effecting telescoping between said shaft and sleeves including a first linkage coupled between the shaft of said first scissors member and the sleeve of said second scissors member, and a second linkage coupled between the shaft of said second scissors member and the sleeve of said first scissors member.

5. An elevating device as set forth in claim 4 wherein each of said sleeves has an upper end and a lower end and is pivotable about a common horizontal axis intermediate its upper and lower ends, the lower end of each sleeve being telescoped about its respective shaft, and wherein said first linkage is coupled between the shaft of said first scissors member and the lower end of the sleeve of said second scissors member and said second linkage is coupled between the shaft of said second scissors member and the lower end of the sleeve of said first scissors member such that the pivoting motion of the sleeve of one scissors member is translated via the linkage to which it is coupled to a telescoping force on the shaft of the other scissors member.

6. An elevating device as set forth in claim 5 wherein said shafts have lower ends which are rigidly fixed to a corresponding pair of support bars having respective, horizontally extending, lengthwise axes about which said support bars are pivotable, and wherein each linkage has one end thereof mounted on one of said support bars and an opposing end coupled to a sleeve of a scissors member, whereby upon actuation of said power means, said sleeves pivot about said common axis and said linkages translate such pivoting via said support bars to a force on said shafts for extending said shafts.

7. An elevating device as set forth in claim 6 wherein each linkage includes a support bracket and an associated, elongated link bar, each support bracket being rigidly connected to a support bar and each link bar being pivotably connected at one end thereof to a sleeve of a scissors member and pivotably connected at an opposed end to its associated support bracket, whereby the pivoting of a sleeve of a scrissors member is translated via a link bar, its associated support bracket, and a support bar to a telescoping force on the shaft of the other scissors member.

8. An elevating device as set forth in claim 6 wherein said support bars are mounted on a horizontally extending platform, one support bar being fixed on the platform and the other support bar being mounted for horizontal movement thereon.

9. An elevating device comprising:

first and second crossed scissors members pivoted for movement relative to each other, each crossed scissors member including an outer sleeve and an inner shaft disposed in telescoping relationship, said first scissors member including a pair of elongated, substantially parallel, telescoping arms horizontally spaced from each other and pivotable about a common axis, each arm including an outer sleeve and an inner shaft, the shafts of said telescoping arms being joined at a common end by a first support bar extending along a substantially horizontal axis about which said first support bar is pivotable, said second scissors member including a single telescoping arm having an outer sleeve and an inner shaft, said second scissors member being positioned between the arms of said first scissors member and being pivotable about said common axis, the shaft thereof being connected to a second support bar extending along a horizontal axis about which said second support bar is pivotable, power means for effecting pivoting of said first and second scissors members; and means responsive to the pivoting movement of said first and second scissors members for effecting telescoping between the shafts and sleeves of the respective scissors members so as to vertically extend the elevating device.

10. An elevating device as set forth in claim 9 wherein said means for effecting telescoping between said shafts and sleeves includes a first linkage mounted on said first supporting bar and connected to the sleeve of said second scissors member and a second linkage mounted on said second supporting bar and coupled to the sleeves of said first scissors members, whereby upon pivoting of said first and second scissors members, said linkages exert a force on the shafts to which they are coupled for telescoping the shafts relative to their respective sleeves.

11. An elevating device as set forth in claim 10 wherein said first and second support bars are mounted on a horizontally extending base, and further including third and fourth scissors members substantially identical to said first and second scissors members, respectively, and mounted atop said first and second scissors members, the sleeves of said third scissors member being pivotally coupled to the sleeves of said first scissors member, the shafts of said third and fourth scissors members being connected to third and fourth support bars, respectively, extending along substantially horizontal axes, and third and fourth linkages coupling the sleeves of said third and fourth scissors members to said fourth and third support bars, respectively.

12. An elevating device as set forth in claim 11 further including a work platform mounted on said third and fourth support bars, whereby upon pivoting of all said scissors members, said linkages effect telescoping of said scissors members and raise said work platform.

13. An elevating device as set forth in claim 3 wherein said first and second crossed scissors members each includes an outer sleeve having first and second opposed open ends, a first shaft disposed in telescoping relationship with the first open end of said sleeve and a second shaft disposed in telescoping relationship with the second open end of said sleeve.

14. An elevating device as set forth in claim 3 further including a pair of crossed, non-telescoping scissors members pivotably coupled to and mounted atop said first and second scissors members.

15. An elevating device as set forth in claim 14 further including an additional pair of telescoping scissors members, similar to said first and second scissors members, mounted atop and pivotably coupled to said pair of non-telescoping scissors members.

16. An elevating device comprising:

first and second crossed scissors members pivoted for movement relative to each other, each crossed scissors member including an outer sleeve and an inner shaft disposed in telescoping relationship, said first and second scissors members being pivotably connected together for pivoting movement about a common horizontal axis, and power means for effecting pivoting of said first and second scissors members said power means including an extendible piston coupled between an upper end of the sleeve of said first scissors member and the interconnection of said first and second scissors members such that, upon extension of said piston, said first and second scissors members pivot about the common axis.

* * * * *